United States Patent [19]

Seaberg

[11] 4,265,319

[45] May 5, 1981

[54] PUSHBEAM TO BLADE HINGE CONNECTION

[75] Inventor: David H. Seaberg, Davenport, Iowa

[73] Assignee: J. I. Case Company, Racine, Wis.

[21] Appl. No.: 967,465

[22] Filed: Dec. 7, 1978

[51] Int. Cl.[3] ..... E02F 3/76

[52] U.S. Cl. ..... 172/811

[58] Field of Search ..... 172/801-809

[56] References Cited

U.S. PATENT DOCUMENTS

| | | | |
|---|---|---|---|
| 2,276,586 | 3/1942 | McIntosh | 172/801 |
| 2,404,760 | 7/1946 | Washbond | 172/801 |
| 2,408,268 | 9/1946 | Peterson | 172/803 |
| 2,624,132 | 1/1953 | Henry | 172/809 |
| 2,679,120 | 5/1954 | Wooldridge | 172/809 |
| 3,329,232 | 7/1967 | Salna | 172/801 |
| 3,337,974 | 8/1967 | Fisher | 172/807 |

FOREIGN PATENT DOCUMENTS

| | | | |
|---|---|---|---|
| 377482 | 6/1973 | U.S.S.R. | 172/806 |

*Primary Examiner*—Richard J. Johnson

*Attorney, Agent, or Firm*—Cullen, Sloman, Cantor, Grauer, Scott & Rutherford

[57] ABSTRACT

The blade of an earthworking vehicle is mounted to pushbeams by pivotal L-shaped hinge body connections permitting pivotal movement of the blade about a transverse horizontal axis in the body of the blade. The hinge connections are retained on the forward end of each pushbeam. The connections have a hinge pin leg disposed parallel to the plane of the blade, in the body of the blade, and another leg secured to the forward end of the pushbeam. In the preferred embodiment, the longitudinal axis of the hinge pin leg is disposed inside the body of the blade, between the face and rear wall, thereby reducing the torsional load on the blade and stabilizing the blade. More open space is provided between the tracks and the rear of the blade which reduces the possibility of debris build-up. In an alternate embodiment of the hinge connection between the blade and pushbeams, the longitudinal axis of a hinge pin is located within the body of the blade which stabilizes the blade and provides more open space between the tracks and the back of the blade as in the preferred embodiment.

1 Claim, 4 Drawing Figures

FIG. 3
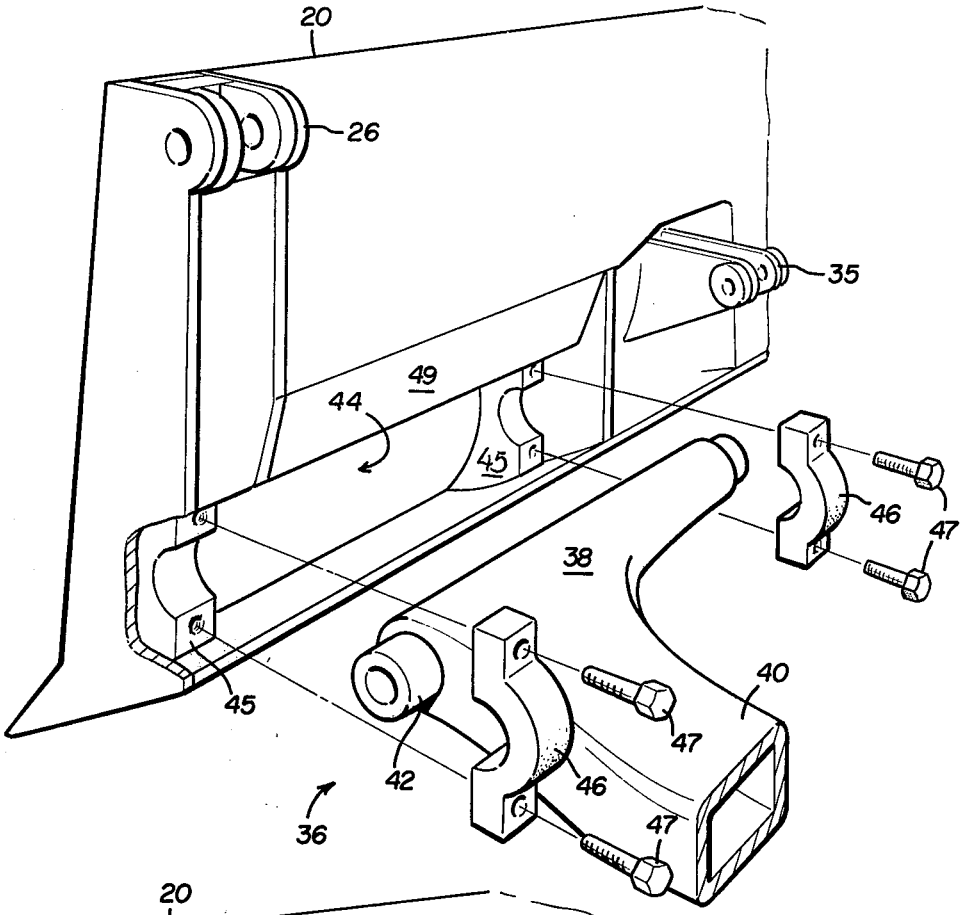
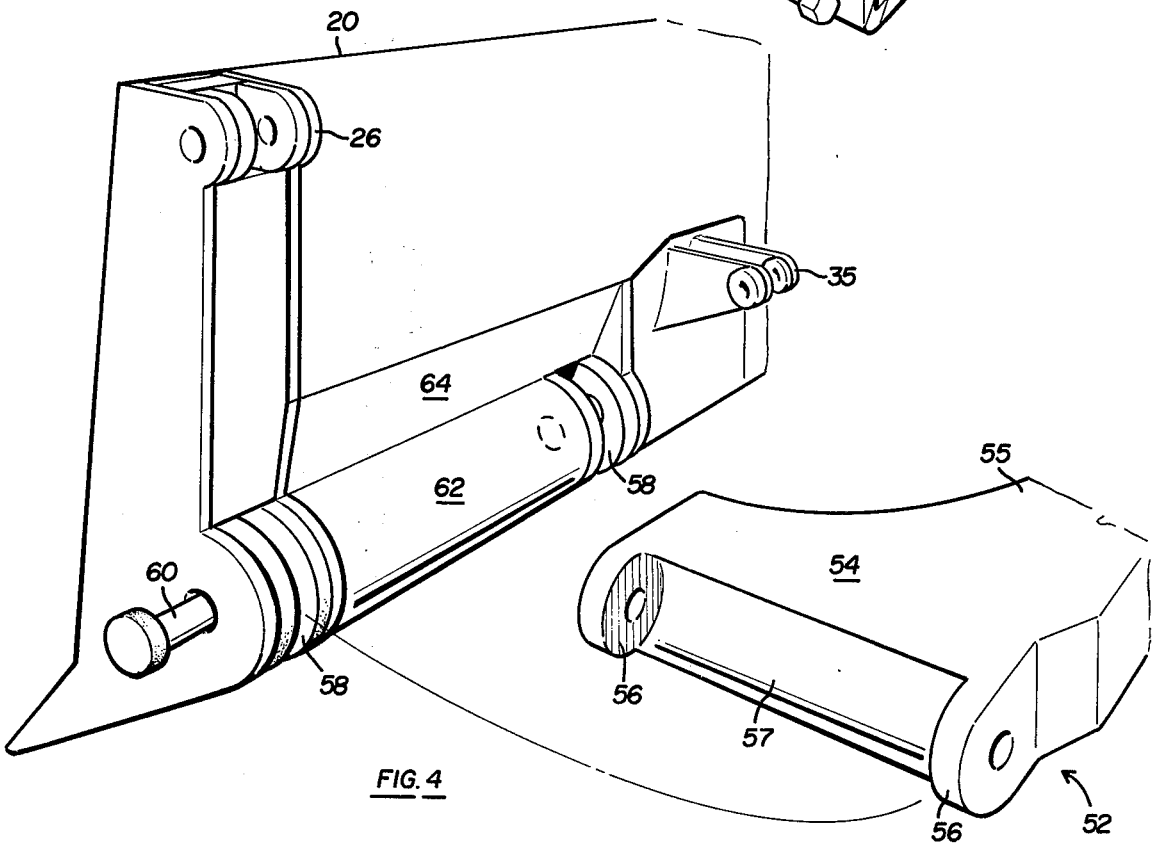
FIG. 4

PUSHBEAM TO BLADE HINGE CONNECTION

BACKGROUND OF THE INVENTION

The present invention relates to bulldozers or the like having transversely extending blades and, more particularly, to a hinge connection between the dozer blade and pushbeams.

The blade of many earth-working vehicles is pivotally mounted forwardly of the front end of the main frame on pushbeams or push arms which extend rearwardly and flank the track frames. The pushbeams are pivotally connected to the track frames near the rear of the vehicle. The prior art pivotal connections between the blade and pushbeams increase the projection of the blade beyond the front of the dozer tracks which is undesirable.

It is conventional practice to provide clevis-type connections between the pushbeams and the back of the blade for permitting movement of the blade about a transverse horizontal axis. These pivotal connections typically prevent the blade from being mounted close to the tractor by requiring additional spacing between the blade and the vehicle. There has been a need for a hinge connection between the dozer blade and the pushbeams which reduces the overall machine length thereby improving machine stability and maneuverability.

The prior art pivotal connections have prevented other desirable features in connection with blade mounting and movement on the bulldozer. The clevis-type connections are typically located near the lower end of the blade and on the backside thereof. They include spaced-apart lugs which are welded or otherwise secured to the back of the blade. A yoke portion on the respective pushbeams is pivotally connected between the lugs by a pin to permit pivotal movement about a transverse horizontal axis by the blade on the pushbeams. These connections are somewhat loosely fitted, and they permit slight uncontrolled movement of the blade. For example, they yield to a limited extent when the blade is subjected to lateral loads thereby permitting the positional setting of the blade to change which is undesirable. Thus, there has been a need for a hinge connection that stabilizes the blade against uncontrolled movement.

Another problem associated with prior art hinge connections is that debris falls over the top of the blade during operation of the bulldozer and becomes trapped between the clevis-type pivotal connections and pushbeams. This can result in damage to the pivotal connections, blade or pushbeams during pivotal movement of the blade about a horizontal axis. There has been a need for a hinge connection that provides more open space between the tracks and the back of the blade to reduce the possibility of debris accumulation.

These disadvantages of present bulldozer blade hinge connections have resulted in the hinge connection in the present invention which reduces the overall projection of the blade beyond the front of the tracks, improves the control of the blade, and reduces the possibility of debris build-up.

SUMMARY OF THE INVENTION

The hinge connection of the present invention may be utilized in a conventional bulldozer where the blade and push arms thereof form a substantially U-shaped structure. The bulldozer includes a conventional transverse scraper blade carried at the forward ends of laterally-spaced pushbeams which flank the track frames and are independently pivoted to the frames. The blade is raised and lowered by conventional hydraulic actuators supported on opposite sides of the engine housing and having piston rods pivotally connected to the back of the blade.

It is a principal object of the invention to provide hinge connections interconnected between the bulldozing blade and the pushbeams which increase the blade stability and improve the controllability of the blade. The overall machine length is reduced because the hinge connections fit within the body of the blade. Additionally, the hinge construction provides more open space between the tracks and the back of the blade to prevent debris build-up.

In the preferred embodiment of the invention, the hinge connection between the blade and pushbeams includes a L-shaped body fitted onto the forward end of each pushbeam with one leg of the body being disposed parallel to the backside of the blade, and the other leg secured to the forward end of the pushbeam. The leg disposed parallel to the backside of the blade acts like a hinge pin in that it is pivotally secured and enclosed within a housing formed in the backside of the blade. Pivot bearing surfaces on the opposite ends of the hinge pin leg are pivotally mounted within bearing blocks in the blade housing. The blade pivots freely about the horizontal longitudinal axis of the hinge pin leg. The pivotal hinge connection is housed within the body of the blade thereby reducing the projection of the blade beyond the front of the tracks.

Severe transverse forces and torsional forces are absorbed by the pivotal connection housed within the blade. When an end of the blade contacts a stationary object, the transverse force is transmitted along the blade and through the hinge pin leg to the main frame of the tractor. The hinge pin leg stabilizes the blade because it is subjected to buckling rather than the bending which occurs in prior art clevis-type connections having lugs cantilevered from the rear blade body. This reduces the slightly uncontrolled movement that a blade undergoes because of prior art clevis-type pivotal connections which depend from the back of the blade and which yield slightly when transverse forces are applied to the blade. With the pivotal connection housed within the blade, the cutting edge of the blade is closer to the horizontal pivot axis of the blade, and this reduces the torsional loads imposed upon the blade and pivotal connection.

The longitudinal axis of the hinge pin leg of the L-shaped hinge body is contained within the blade. Thus, there is less likelihood that debris will become trapped at the pivotal connections between the blade and pushbeams because there are no depending lugs as is conventional with clevis-type pivotal connections. More open space between the tracks and the rear of the blade is provided by the present pivot construction which reduces the possibility of debris build-up.

In a second embodiment of the present invention, the blade is connected to the pushbeams by a L-shaped hinge body having laterally spaced ears projecting from a leg portion disposed parallel to the backside of the blade. The exterior surface of the hinge leg is concavely shaped between the ears. The ears fit between spaced apart bearing lugs formed in the backside of the blade, and a hinge pin connects the ears to the bearing lugs thereby permitting pivotal movement by the blade about a transverse horizontal axis.

The exterior surface of the blade is convexly shaped between the bearing lugs to complement the concavely shaped exterior surface of the hinge body between its ears. This permits the blade to pivot about a transverse horizontal axis without binding against the pushbeams. The overall projection of the blade beyond the front of the tracks is reduced, and more open space between the tracks and the back of the blade reduces the possibility of debris build-up.

Other advantages and meritorious features of the hinge connections taught by the present invention will be more fully understood from the following description of the preferred embodiments, the appended claims, and the drawings, a brief description of which follows.

BRIEF DESCRIPTION OF THE DRAWINGS

FIG. 3 is an enlarged, fragmentary perspective view of one embodiment of the hinge connection of the present invention; and FIG. 4 is an enlarged fragmentary perspective view of a second embodiment of the hinge connection of the present invention.

DESCRIPTION OF THE PREFERRED EMBODIMENTS

Figure 1:
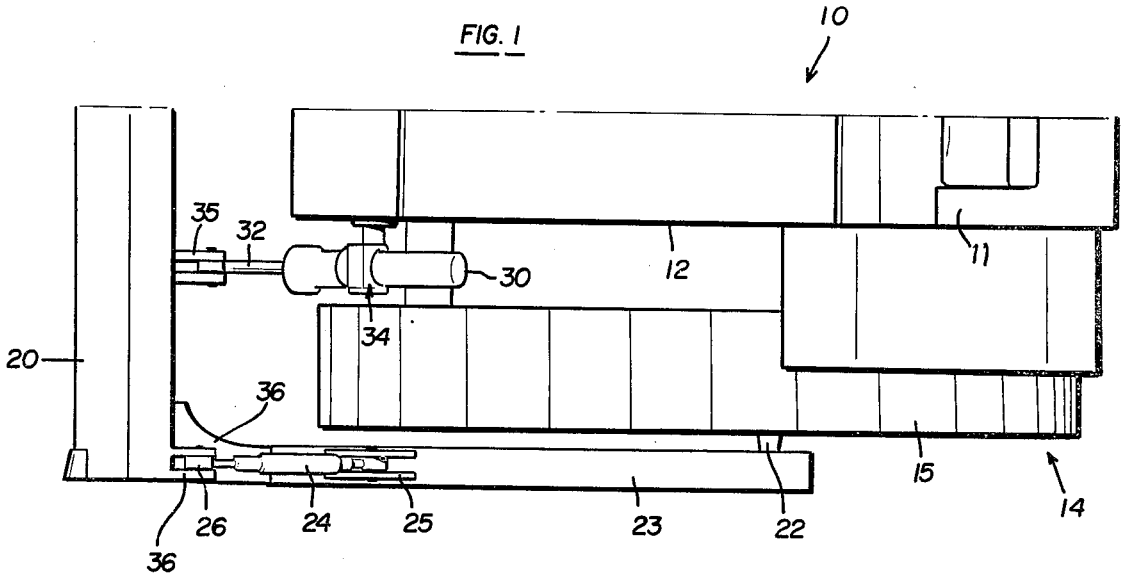
FIG. 1 is a plan view of an earth-working vehicle embodying the invention.
Figure 2:
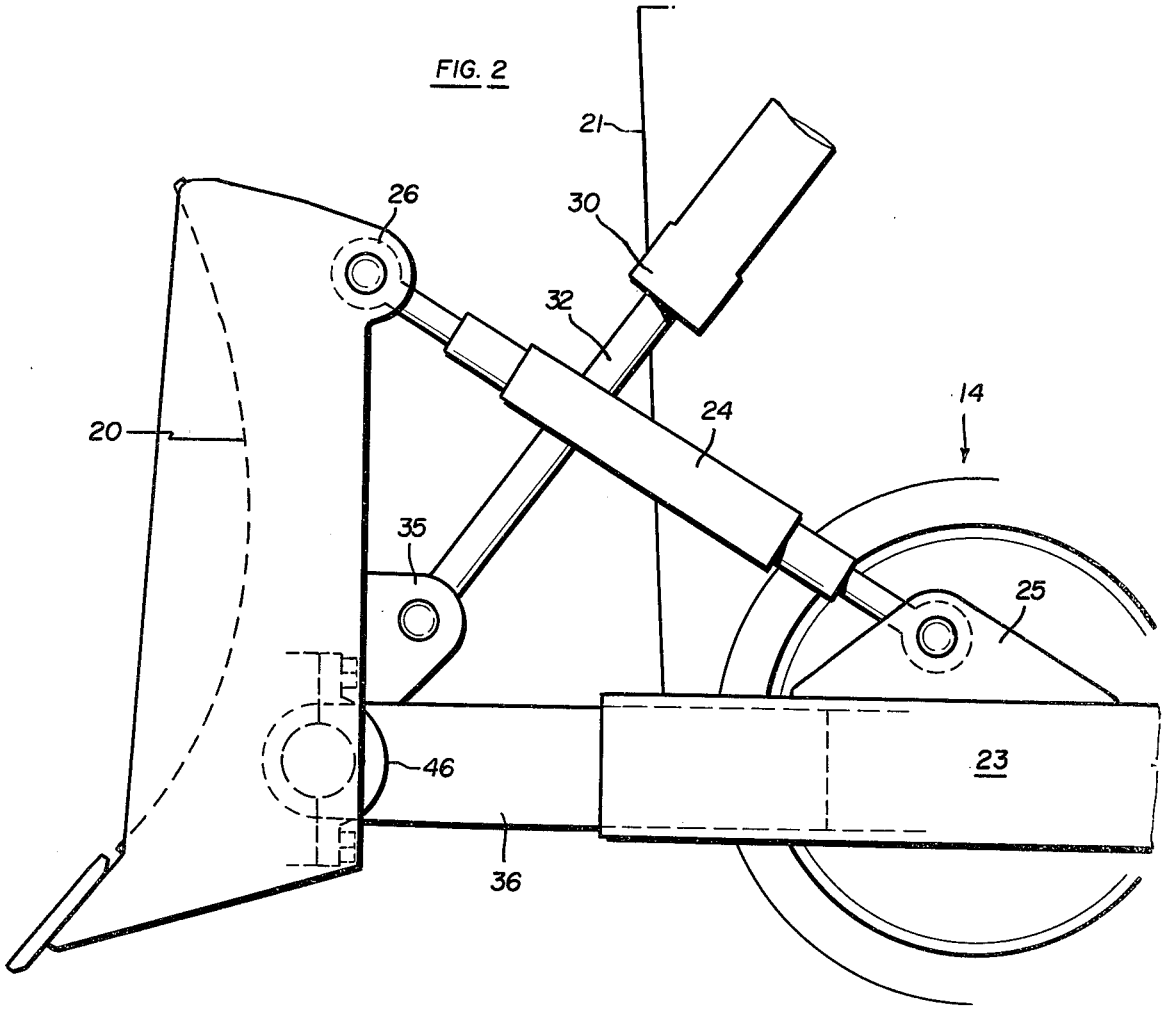
FIG. 2 is a side elevational view of the earth-working vehicle embodying the invention.

A bulldozer blade mounted on pushbeams of an earth-working vehicle and having one embodiment of the hinge connection of the present invention is shown in FIGS. 1–3. A second embodiment is illustrated in FIG. 4 and it will be understood that the hinge connection may be utilized in other implements having the prior art problems described hereinabove. For example, the hinge connection may be utilized in a wheeled vehicle or tractor. The following description will be limited to a bulldozer of the type shown for simplicity of illustration.

A preferred embodiment of an earth-working vehicle including a hinge connection made in accordance with the teachings of the present invention is illustrated in FIGS. 1–3. The tractor 10 shown in FIG. 1 is seen to include an operator's station generally indicated at 11 and a main frame 12 flanked by a pair of drive track frames 14. As is well-known, track roller assemblies (not shown) may be provided on each of the track frames 14 for engaging track chains 15.

The bulldozer includes a conventional transverse scraper blade 20 mounted forwardly of the front end 21 of the frame 12. The blade 20 is carried at the forward ends of laterally spaced pushbeams 23 which flank the track frames 14 and are independently pivoted by universal joints 22 to the conventional track roller frames 14. The blade 20 is secured to the push arms 24 by means of a hinge connection 36 located near the lower end of the blade and on the backside thereof. As will be recognized by those skilled in the art, the hinge connection 36 provides for pivotal mounting of the blade on the push arms 23 for movement about a horizontal transverse axis.

The blade 20 is raised and lowered by conventional hydraulic actuators or lift cylinders 30 supported on opposite sides of the engine housing by trunnion mountings 34 and having piston rods 32 pivotally connected to lugs 35 mounted to the back of the blade. The upper end of the blade is stabilized by mechanical struts 24 mounted at one of their ends 25 to the pushbeams 23 and at their other ends 26 to the blade.

The present invention includes pivotal hinge connections 36 connecting the bulldozing blade 20 to the pushbeams 23 for pivotal movement about a transverse horizontal axis. The machine length is reduced because the hinge connections fit within the body of the blade, and the stability and the controllability of the blade are increased. More open space is provided between the tracks and the back of the blade which reduces the possibility of debris build-up.

In the preferred embodiment of the invention illustrated in FIG. 3, each pushbeam 23 is connected to blade 20 by hinge connection body 36. L-shaped hinge body 36 is fitted onto the forward end of each pushbeam with one leg 38 of the body being disposed parallel to the backside of the blade, and the other leg 40 being secured to the forward end of the pushbeam. Leg 40 of each pivotal connection is welded or otherwise secured to the pushbeams 23. As illustrated, leg 40 may be telescopically received within pushbeam 23 and secured thereto to permit easy attachment for repair or replacement of hinge body 36.

Hinge body leg 38, which acts as a hinge pin, is pivotally secured and enclosed within housing 44 formed in the backside of the blade 20. Circular pivot bearing surfaces 42 of leg 38 are secured for pivotal movement within bearing block assemblies including bearing block halves 45, 46 and securing bolts 47. The blade is free to pivot about the longitudinal axis of hinge pin leg 38.

Blade housing 44 includes an inclined relief surface 49 which permits the blade to pivot about the longitudinal axis of hinge leg 38 without binding. Bearing halves 45 are mounted to the interior sidewalls of housing 44, and they surround one-half of bearing surfaces 42 when the hinge body 36 is assembled to the blade.

There are several advantages in the present invention over the prior art. By locating the longitudinal axis of the hinge pin leg 38 within the body of the blade, the projection of the blade is reduced beyond the front of the tracks. If lateral forces are imposed on the blade, the force is transmitted through the blade and hinge pin leg to the main frame thereby reducing the slightly uncontrolled movement of the blade because of prior art clevis-type pivotal connections. With the hinge pin leg housed within the blade body, the cutting edge of the blade is closer to the pivot axis of the blade which reduces the torsional loads imposed on the blade and pivotal connection. There is less likelihood of trapped debris at the pivotal connections because the present invention provides more open space between the tracks and the rear of the blade.

In a second embodiment of the present invention illustrated in FIG. 4, the blade is connected to each pushbeam 23 by a L-shaped hinge body 52. The hinge body 52 is fitted onto the forward end of each pushbeam with one leg 54 of the L-shaped body being disposed parallel to the backside of the blade, and the other leg 55 being secured to the forward end of the pushbeams. Leg 55 is welded to pushbeam 23 or mounted thereto for detachment. Hinge body leg 54 has laterally spaced ears 56 projecting from it, and the exterior surface 57 of leg 54 is concavely shaped between ears 56. Ears 56 fit between spaced apart bearing lugs 58 in the backside of the blade 20, and a hinge pin 60 connects the hinge body 52 to the blade bearing lugs 58 permitting pivotal movement by the blade about a horizontal transverse axis.

The exterior surface 62 of the blade is convexly shaped between the bearing lugs 58 to complement the concave exterior surface 57 of hinge leg 54. An inclined relief surface 64 is formed on the backside of blade 20 above the bearing lugs 58 to permit the blade pivotal movement about a transverse horizontal axis without binding against the hinge body connection. As with the first embodiment, the projection of the blade beyond the front of the tracks 15 is reduced.

It will be apparent to those skilled in the art that the foregoing disclosure is exemplary in nature rather than limiting, the invention being limited only by the appended claims. What is claimed is:

1. In an earth-working machine having a frame and a transverse blade body at the forward end thereof, a pair of spaced apart pushbeams each pivotally secured at one end to said frame on opposed sides of said machine, and said pushbeams pivotally secured to said blade body at their opposed ends, the improvement comprising:

said blade body including a rear wall spaced from a forward wall, and said blade body being pivotally secured to said pushbeams by hinge connection bodies, each said hinge body being of generally L-shaped one-piece construction and having a hinge pin leg disposed parallel to the backside of said blade and a second leg telescopically received in the forward end of a respective pushbeam, and housings formed within said blade body forwardly of said rear wall for mounting said hinge pin legs;

means for pivotally securing each hinge pin leg within a respective housing formed in the blade body thereby permitting pivotal movement by said blade about a transverse, horizontal, pivot axis, each hinge pin leg including pivot bearing surfaces on the opposite ends of said hinge pin leg, and said securing means including bearing blocks mounted to opposed interior side walls of each said housing for mounting a hinge pin leg within a respective blade housing;

each housing including an inclined relief surface along one of its exterior edges which permits said blade to pivot about the longitudinal axes of said hinge pin legs without binding; and said horizontal, transverse pivot axis between said blade and said hinge pin legs being disposed within the housings of said blade body and forward of said rear wall thereby limiting the torsional load on said blade.

* * * * *